US009783207B2

(12) United States Patent
Rider

(10) Patent No.: US 9,783,207 B2
(45) Date of Patent: Oct. 10, 2017

(54) TOWING APPARATUS

(71) Applicant: INNOVA PATENT GMBH, Wolfurt (AT)

(72) Inventor: Roland Rider, Edinburgh (GB)

(73) Assignee: Innova Patent GmbH, Wolfurt (AT)

( * ) Notice: Subject to any disclaimer, the term of this patent is extended or adjusted under 35 U.S.C. 154(b) by 176 days.

(21) Appl. No.: 14/439,623

(22) PCT Filed: Nov. 1, 2013

(86) PCT No.: PCT/GB2013/052864

§ 371 (c)(1),
(2) Date: Apr. 29, 2015

(87) PCT Pub. No.: WO2014/068328

PCT Pub. Date: May 8, 2014

(65) Prior Publication Data

US 2015/0298707 A1 Oct. 22, 2015

(30) Foreign Application Priority Data

Nov. 1, 2012 (GB) ..... 1219680.4

(51) Int. Cl.
*B61B 12/12* (2006.01)
*B61B 11/00* (2006.01)

(52) U.S. Cl.
CPC ..... *B61B 11/006* (2013.01)

(58) Field of Classification Search
CPC .... B61B 3/00; B61B 3/02; B61B 7/00; B61B 9/00; B61B 12/12; E01B 25/00; E01B 25/08; E01B 25/22
See application file for complete search history.

(56) References Cited

U.S. PATENT DOCUMENTS 4,284,010 A * 8/1981 Marshall ..... B60L 13/00 104/171
6,994,359 B1 2/2006 Silver
(Continued)

FOREIGN PATENT DOCUMENTS

CH 245572 A 11/1946
DE 19856755 A1 6/2000
(Continued)

*Primary Examiner* — R. J. McCarry, Jr.
(74) *Attorney, Agent, or Firm* — Laurence A. Greenberg; Werner H. Stemer; Ralph E. Locher

(57) ABSTRACT

The present invention relates to towing apparatus (200) for towing a vehicle with a cable transport arrangement. The towing apparatus (200) comprises a first attachment arrangement (204) configured to provide for attachment to a towing part of the cable transport arrangement. The towing apparatus (200) comprises a second attachment arrangement (208) configured for releasable attachment to a vehicle. The second attachment arrangement (208) comprises a main body (210) and first and second arms (212,214). The first and second arms (212,214) are substantially immovably mounted on the main body (210) and spaced apart from each other with each of the first and second arms defining a vehicle engaging profile (222). The second attachment arrangement (208) is rotatable such that the first and second arms (212,214) move between: a first position in which the vehicle engaging profiles (222) can be brought into engagement with or disengaged from a part of the vehicle; and a second position in which the vehicle engaging profiles (222) engage with the part of the vehicle so as to provide for towing of the vehicle.

22 Claims, 9 Drawing Sheets

(56) References Cited

U.S. PATENT DOCUMENTS

| | | | | |
|---|---|---|---|---|
| 7,441,506 | B2 * | 10/2008 | Bruns | B61B 10/04 104/118 |
| 2004/0074415 | A1 | 4/2004 | Aaltonen et al. | |
| 2006/0076380 | A1 | 4/2006 | Ockenden | |

FOREIGN PATENT DOCUMENTS

| | | | |
|---|---|---|---|
| EP | 0247268 | A1 | 12/1987 |
| EP | 1514789 | A2 | 3/2005 |
| FR | 2592349 | A1 | 7/1987 |
| FR | 2594396 | A2 | 8/1987 |
| FR | 2601637 | A2 | 1/1988 |
| FR | 2693971 | A1 | 1/1994 |
| JP | S5431668 | U | 3/1979 |
| KR | 20100132602 | A | 12/2010 |
| WO | 0013956 | A1 | 3/2000 |
| WO | 2006039477 | A2 | 4/2006 |

* cited by examiner

TOWING APPARATUS

FIELD OF THE INVENTION

The present invention relates to towing apparatus for towing a vehicle with a cable transport arrangement, a towing part of a cable transport arrangement comprising such towing apparatus and a cable transport arrangement comprising such towing apparatus.

BACKGROUND TO THE INVENTION

It is known to provide cable transport arrangements, such as the Poma tow, at ski slopes to provide for skier uplift. Such cable transport arrangements have been modified to provide for uplift of vehicles. US 2004/0074415 describes a cable transport arrangement which is configured to tow a wheeled vehicle over the ground. The cable transport arrangement of US 2004/0074415 comprises a towing rope which forms a loop at its distal end. A rigid member which extends from the vehicle is received in the loop whereby the vehicle is towed by the cable transport arrangement. Towing of the vehicle ceases when the loop of material is disengaged from the rigid member by ground mounted apparatus, which is operative to ease the loop from the rigid member as the vehicle passes the ground mounted apparatus.

The present inventor has become aware of shortcomings in approaches to towing vehicles with cable transport arrangements, such as the approach described by US 2004/0074415.

The present invention has been devised in the light of the inventor's aforementioned appreciation. It is therefore an object for the present invention to provide improved towing apparatus for towing a vehicle with a cable transport arrangement. It is a further object for the present invention to provide towing apparatus for towing a vehicle with a cable transport arrangement, the towing apparatus comprising an attachment arrangement which is configured for releasable attachment to the vehicle.

STATEMENT OF INVENTION

According to a first aspect of the present invention there is provided towing apparatus for towing a vehicle with a cable transport arrangement, the towing apparatus comprising:

- a first attachment arrangement configured to provide for attachment to a towing part of the cable transport arrangement; and
- a second attachment arrangement configured for releasable attachment to a vehicle, the second attachment arrangement comprising a main body and first and second arms, the first and second arms being substantially immovably mounted on the main body and spaced apart from each other, each of the first and second arms defining a vehicle engaging profile,
- the second attachment arrangement being rotatable such that the first and second arms move between: a first position in which the vehicle engaging profiles can be brought into engagement with or disengaged from a part of the vehicle; and a second position in which the vehicle engaging profiles engage with the part of the vehicle so as to provide for towing of the vehicle.

The towing apparatus is fixed by way of the first attachment arrangement to a towing part, e.g. to a hanger, of the cable transport arrangement, e.g. such that the towing apparatus is not readily removable from the towing part. Typically a towing apparatus may be fixed to each of plural towing parts and as the cable transport arrangement operates the plural towing parts move with their respective attached towing apparatus. When it is desired to tow a vehicle the second attachment arrangement is disposed relative a part of a vehicle such that the first and second arms are in the first position and the vehicle engaging profiles are then brought into engagement with the part of the vehicle by rotation of the second attachment arrangement such that the first and second arms are in the second position. The second attachment arrangement may be configured such that the vehicle is towed upon exertion of a towing force on the vehicle by the second attachment arrangement. For example and where the vehicle is a bicycle the vehicle engaging profiles may be brought into engagement with the handle bars of the bicycle. The second attachment arrangement thereby connects the towing apparatus to the vehicle and enables the cable transport arrangement to tow the vehicle by way of the towing part. When towing is complete the second attachment arrangement is rotated such that the first and second arms move from the second position to the first position whereby the vehicle engaging profiles and hence second attachment arrangement disengage from the vehicle.

The towing apparatus may be configured such that the second attachment arrangement is rotatable about an attachment arrangement axis. A direction of a towing force exerted by the towing apparatus when in use may substantially coincide with the attachment arrangement axis. The towing apparatus may be configured such that, in use, a towing part, e.g. a hanger, of the cable transport arrangement, lies substantially on the attachment arrangement axis. An attachment location on the first attachment arrangement at which the first attachment arrangement attaches to the towing part may lie substantially on the attachment arrangement axis. Where the towing part, e.g. hanger, allows for rotation, e.g. on account of comprising a length of rope or comprising a rotatable coupling, the second attachment arrangement may rotate about the attachment location on the first attachment arrangement.

Each of the first and second arms may extend away from an attachment location on the first attachment arrangement at which the first attachment arrangement attaches to the towing part. The first and second arms may extend from a distal part of the main body, e.g. from an end of the main body opposite where the main body attaches by way of the first attachment arrangement. Each of the first and second arms may extend from the distal part of the main body by between substantially 20 mm and substantially 60 mm. Alternatively or in addition first and second arms and more specifically distal portions of the first and second arms may extend generally perpendicularly to the attachment arrangement axis. A distal portion of an arm may extend by between substantially 20 mm and substantially 40 mm in a direction perpendicular to the attachment arrangement axis. The first and second arms and more specifically distal portions of the first and second arms may extend in generally and perhaps substantially opposite directions. More specifically and in certain embodiments the first and second arms may each extend along part of a generally circular path. Where the second attachment arrangement is rotatable about an attachment arrangement axis the generally circular path may extend around the attachment arrangement axis. The attachment arrangement axis may substantially coincide with a centre of the generally circular path. Each of the first and second arms may define a nonlinear path and more specifically a curved path between a proximal part of the arm where the arm attaches to the main body and a distal part of the arm. The proximal part of the first arm and the proximal part of the second arm may oppose each other.

In alternative embodiments each of the first and second arms may define a nonlinear path between proximal and distal ends of the arms with each arm comprising first and second substantially linear portions with an angled portion therebetween. A surface of the first arm may define a first vehicle engaging profile and a surface of the second arm may define a second vehicle engaging profile. The first and second vehicle engaging profiles may be similar or substantially the same with the first and second vehicle engaging profiles being generally and perhaps substantially oppositely directed. More specifically each of the first and second vehicle engaging profiles may define at least in part a recess. A base of each recess may be shaped to fit around a part of a vehicle, such as a handle bar of a bicycle. The configuration of the first and second arms may be such that the second attachment arrangement is rotated by between substantially 70° and substantially 75° when being moved between the first and second positions.

Each of the first and second arms may comprise a distal portion. The distal portion may define a surface, which forms part of the vehicle engaging profile, with the surface lying on a plane which is at an angle of at least substantially 95°, 100°, 105°, 110°, 115°, 120° or 125° to a direction of a towing force when the towing apparatus is in use. The direction of the towing force may substantially coincide with the attachment arrangement axis. Alternatively or in addition the surface may lie on a plane which is at an angle of no more than substantially 130°, 125°, 120°, 115°, 110°, 105° or 100° to a direction of a towing force when the towing apparatus is in use. In certain forms of the invention the surface may lie on a plane which is at an angle of between substantially 110° and substantially 115° to a direction of a towing force on the towing apparatus when in use. When an arm comprises first and second substantially linear portions with an angled portion therebetween, the second portion may extend at an angle of between substantially 110° and substantially 115° to the first portion. Such forms of the invention have been found appropriate when the towing apparatus comprises a rigid protruding member (as described below) for which the distal end is about 180 mm from a location between the first and second arms or when the towing apparatus comprises a part rigid and part pliable handle (as described below) in which the rigid portion is about 120 mm long and when a range of weights are towed, such as children or heavy adults when being towed on a bicycle up a steep slope.

A distal portion of an arm may be of a thickness of between substantially 5 mm and substantially 12.5 mm and more specifically substantially 10 mm. At least one of a width and a height of the distal portion may be of such dimensions. A distal portion of such dimensions may be more readily able to fit between the handlebars of a bicycle and the upper triple clamp.

The main body may be generally or substantially frustroconical. In an alternative form the main body may be generally disc shaped. The main body may be hollow. Each of the first and second arms may extend from a base of the main body. The first attachment arrangement may be attached at an end of the main body opposite the base.

The main body and the first and second arms may be integrally formed from a substantially rigid material, e.g. from a plastics material such as acrylonitrile butadiene styrene (ABS). In an alternative form the main body may comprise a metal chassis which is formed, for example, from stainless steel and a cover which fits over the metal chassis. The cover may therefore comprise first and second parts which fit together around the metal chassis. The cover may be formed from high density polyethylene (HDPE) or polypropylene. In this alternative form the first and second arms may be formed from metal such as stainless steel. More specifically the first and second arms may be removably attached, for example by way of bolts, to the metal chassis. The second attachment arrangement may be formed by a process such as casting or machining.

The towing apparatus may further comprise a user grippable handle which extends from the second attachment arrangement. The towing apparatus may be configured such that the second attachment arrangement is rotatable between the first and second positions by user operation of the handle. The towing apparatus may be configured such that the second attachment arrangement is maintained in the second position during towing by user operation of the handle. For example the user, such as a cyclist, may apply force to the handle to move the second attachment arrangement from the first position to the second position. The towing apparatus may be configured such that the handle extends generally perpendicularly to the attachment arrangement axis.

The handle may comprise a rigid portion which extends along at least part of a length of the handle. The rigid portion may be at least substantially 50, 75, 90, 100, 110, 115, 120, 125, 130, 140, 150 or 190 mm long. The rigid portion may be no more than substantially 190, 165, 150, 140, 130, 125, 120, 115, 110, 100, 90 or 75 mm long. In certain forms of the invention the rigid portion may be between substantially 115 mm and substantially 125 mm long and more preferably substantially 120 mm long. The rigid portion of the handle may be formed at least in part of a plastics material such acrylonitrile butadiene styrene (ABS). The handle may comprise a pliable portion. The pliable portion may be about 350 mm long. The pliable portion may be formed at least in part from ethylene-vinyl acetate (EVA) foam. The pliable portion may be of greater length than the rigid portion. The pliable and rigid portions may be generally coaxially disposed. The pliable portion may be disposed such that it extends along at least part of the rigid portion. The pliable portion and rigid portion may be attached to each other by way of adhesive. The pliable portion and rigid portion may alternatively or in addition be attached to each other by plastics welding, a mechanical fastener arrangement or the like. In use a part of the pliable portion may be configured to be gripped by the user. For example where the towing apparatus is being used to tow a bicycle the cyclist may grip one of the handle bars and a part of the pliable portion, e.g. such that the part of the pliable portion is held against the handle bar, to thereby exert a force on the second attachment arrangement which opposes a force exerted by towing which tends to move the second attachment arrangement from the second position to the first position. The pliable portion may therefore be gripped by the user to prevent the second attachment arrangement from disengaging from the vehicle. The user may release his or her grip on the pliable portion when it is desired to disengage the second attachment arrangement from the vehicle.

In an alternative embodiment the handle may be comprised of a substantially entirely pliable portion. The pliable portion may be about 400 mm. The handle may therefore lack a rigid portion as described above. The pliable portion may be formed from a plastics material such as an ultraviolet (UV) resistant grade of polyvinylchloride (PVC). In this alternative embodiment the main body may comprise and perhaps define a rigid protruding member which extends from the main body. The rigid protruding member is operative as a lever to help maintain the towing apparatus in situ on the vehicle during towing. The pliable portion may be attached towards a distal end of the rigid protruding member. The rigid portion of the handle described above is therefore constituted as the rigid protruding member of the main body. The rigid protruding member may extend laterally from the main body. The rigid protruding member may extend from the main body in a direction orthogonal to an axis about which the first and second arms rotate between the first and second positions. The rigid protruding member may extend from the main body between the two arms. A distance between a distal end of the rigid protruding member and a location between the two arms may be about 180 mm. Where a diameter across a cover of the towing apparatus is 120 mm, the rigid protruding member may be about 140 mm long. The rigid protruding member may be shaped such that its distal end is beyond the furthest reach of the first and second arms. The rigid protruding member may be shaped such that its distal end is, in use, closer to the vehicle than its proximal end. Shaping the rigid protruding member in this fashion may provide for improved engagement of the first and second arms with the vehicle.

The handle may be formed separately to the attachment arrangement and thereafter be attached to the second attachment arrangement. The handle may be removably attached to the second attachment arrangement. For example the handle may be bolted to the second attachment arrangement. The handle and more specifically a rigid portion of the handle may lie substantially on a plane which is at an angle of no more than substantially 135°, 120°, 105°, 100° or 95° to a direction of a towing force on the towing apparatus. Alternatively or in addition the handle and more specifically a rigid portion of the handle may lie substantially on a plane which is at an angle of more than 90°, 95°, 100°, 105° or 120° to a direction of the towing force on the towing apparatus. Therefore when the handle is gripped, e.g. by holding a pliable portion of the handle against a handlebar, a force may be exerted on the handle in the same direction as the towing force to thereby maintain the second attachment arrangement in the second position. Also the handle, e.g. the pliable portion, may be less liable to become entangled with the towing apparatus.

The first attachment arrangement may define an aperture which is configured to fix the towing apparatus to the towing part. More specifically the first attachment arrangement may comprise a ring which provides for attachment to the towing part. Alternatively or in addition the first attachment arrangement may comprise a bore for receiving an elongate pliable part, e.g. length rope, of the towing part. In use the elongate pliable part may be passed through the bore and tied upon its exit from the bore to thereby provide for secure attachment of the first attachment arrangement to the towing part. The first attachment arrangement may be attached to the second attachment arrangement, e.g. by way of a bolt or by way of cooperating threads. More specifically the first attachment arrangement may be immovably attached to the second attachment arrangement. The first attachment arrangement may be formed at least in part of a metal or a plastics material.

In another embodiment the first and second arms of the towing apparatus may be configured differently and disposed differently on the main body. In the embodiment described above the first attachment arrangement may be disposed such that a towing force is exerted between the first and second arms. In the present embodiment the first attachment arrangement may be disposed such that a towing force is exerted to one side of both of the first and second arms. The towing apparatus may be otherwise configured such that when the towing apparatus is engaged with a vehicle the towing force causes the main body to pivot about the nearer one of the first and second arms to the first attachment arrangement. As a result the part of the main body bearing the other of the first and second arms is urged towards the vehicle. The force with which the other of the first and second arms is urged towards the vehicle may be determined by the relative positions of the first and second arms and the first attachment arrangement. For example increasing a separation between the first attachment arrangement and the arm about which the main body rotates increases the force with which the other arm is urged against the vehicle. The towing apparatus of the present embodiment may therefore be operative to pull one of the arms against the vehicle and to push the other of the arms against the vehicle. This is in contrast to the earlier described embodiment in which both arms pull against the vehicle.

As a result of the configuration of the embodiment described immediately above, one of the arms of the towing apparatus may be configured differently to the other arm to provide for ease of disengagement of the towing apparatus from the vehicle. Nevertheless the vehicle engaging profiles of the two arms may be generally and perhaps substantially oppositely directed. More specifically the vehicle engaging profiles of the two arms may face away from each other. The arm closer to the first attachment arrangement (i.e. pivot arm) may be configured as described above. The other arm (i.e. non-pivoting arm) may, on the other hand, be differently configured. More specifically the other arm may be configured so as to define a vehicle engaging profile which is open on two adjacent sides of four sides. Having a vehicle engaging profile which is open on two adjacent sides of four sides may provide for ease of disengagement of the towing apparatus from the vehicle. In contrast the arm closer to the first attachment arrangement may define a vehicle engaging profile which is open on only one of four sides. The other arm may comprise a first portion which extends away from main body and a second portion which extends from near the proximal end of the first portion in a direction in line with the main body with the vehicle engaging profile being defined by the first and second portions. The first and second portions may therefore extend in generally and perhaps substantially orthogonal directions. In another form the other arm may lack a second portion such that it comprises solely a first portion. In this form a part of the main body, such as a cover for the towing apparatus, may be configured such that it performs the function of the second portion. The arms may be disposed on the main body such that they are offset whereby, in use, the proximal portion of the pivot arm is received on a side of the part of the vehicle further away from the towing part and the first portion of the other arm is received on a side of the part of the vehicle nearer the towing part. Otherwise the present embodiment is the same in respect of its form and function as the previously described embodiment.

According to a second aspect of the present invention there is provided towing apparatus for towing a vehicle with a cable transport arrangement, the towing apparatus comprising:

- a first attachment arrangement configured to provide for attachment to a towing part of the cable transport arrangement; and
- a second attachment arrangement configured for releasable attachment to a vehicle, the second attachment arrangement comprising first and second substantially rigid members, which are movable in relation to each other between a first disposition in which the first and second rigid members engage with a part of the vehicle to thereby provide for towing of the vehicle, and a second disposition in which the towing apparatus is released from the vehicle.

The towing apparatus is fixed to a towing part, e.g. to a hanger, of the cable transport arrangement, e.g. such that the towing apparatus is not readily removable from the towing part. Typically a towing apparatus may be fixed to each of plural towing parts and as the cable transport arrangement operates the plural towing parts move with their respective attached towing apparatus. When it is desired to tow a vehicle the first and second members of the second attachment arrangement of a towing apparatus are brought into engagement with the vehicle. For example and where the vehicle is a bicycle the first and second members of the second attachment arrangement may be brought into engagement with the handle bars of bicycle. The second attachment arrangement thereby attaches the towing apparatus to the vehicle and enables the cable transport arrangement to tow the vehicle by way of the towing part. When towing is complete the first and second rigid members move in relation to each other from the first disposition to the second disposition to disengage from the vehicle and thereby release the towing apparatus from the vehicle.

The second attachment arrangement may be configured such that the first and second members oppose each other. A separation between respective locations on the first and second members may alter when changing between the first and second dispositions. More specifically a separation between the first and second members may decrease when changing from the second disposition to the first disposition.

Alternatively or in addition the first and second members may oppose each other and the second attachment arrangement may be configured such that a separation between respective locations on the first and second members decreases when changing from the second disposition to the first disposition. The first and second members may therefore define jaws which are operative to engage with the vehicle.

The first and second members may be configured to encircle a part of the vehicle when in the first disposition. For example the first and second members may be configured to encircle a cylindrical part, such as the handle bars, of the vehicle.

The first and second members may be configured when in the first disposition for change to the second disposition when the first and second members are urged against a part of the vehicle, such as a cylindrical part of the vehicle. More specifically at least one of a distal portion of the first member and a distal portion of the second member may be configured, such as by an arcuate surface profile, to engage with a part of the vehicle to effect a change from the first disposition to the second disposition when urged against the part of the vehicle. Therefore and where the first and second members define jaws distal portions of the jaws may define arcuate surface profiles which force the jaws apart when the jaws are urged against a part of the vehicle, such as the handle bars of a bicycle. An outside surface of a member may be arcuate whereby urging the member against the part of the vehicle changes to the second disposition to thereby permit the engagement of the members with the vehicle. Alternatively or in addition an inside surface of a member may be arcuate whereby urging the members against the part of the vehicle when the members are in engagement with the part of vehicle opens the members to thereby permit their disengagement from the vehicle.

The second attachment arrangement may comprise a first pair of first and second members and a second pair of first and second members, the first and second pairs being spaced apart from each other. The second attachment arrangement may therefore be configured to engage with a vehicle at spaced apart locations. Such locations may be generally spaced apart from each other on opposite sides of a main axis of the vehicle. For example and where the vehicle is a bicycle the spaced apart locations may be on the handle bars on opposite sides of the stem to which the handle bars are attached. Attaching the second attachment arrangement in this fashion may provide for more stable towing of the vehicle.

The second attachment arrangement may be configured such that the first member may be movable in relation to the second member. Thus the second attachment arrangement may be configured such that the second member may not move.

The towing apparatus may further comprise a latch which is configured when the first and second members are in the first disposition to maintain the first and second members in the first disposition. When engaged the latch may be configured to resist movement of the first and second members from the first disposition to the second disposition. For example and where the second attachment arrangement is attached to the handle bars of a bicycle, the latch may maintain engagement of the first and second members with the handle bars. The towing apparatus may be configured for application of force to engage the latch. In the absence of the applied force the latch may disengage and the first and second members may be liable to disengage from the vehicle. The towing apparatus may further comprise a biasing device, such as a spring, which is operative to disengage the latch in the absence of an applied force. Disengagement of the latch may allow for movement of the first and second members from the first disposition to the second disposition to thereby allow for release of the towing apparatus from the vehicle.

The latch may comprise a user operable actuator, which is operable to engage the latch. The user may be a person operating the vehicle to be or being towed, e.g. the cyclist where the vehicle is a bicycle. The latch may be configured to require application of force, e.g. against the bias of a biasing device, to engage the latch and maintain engagement of the latch. Removal of force by the user may disengage the latch to thereby allow for disengagement of the towing apparatus from the vehicle. If the user encounters a difficulty, e.g. where there is a loss of balance, release of the actuator may cause a removal of applied force whereby the towing apparatus disengages from the vehicle. The latch may therefore provide for improved safety of use of the towing apparatus.

The user operable actuator may comprise a grippable member. The grippable member may be elongate in form. The grippable member may extend laterally from the towing apparatus. Where the towing apparatus comprises first and second pairs of first and second members the grippable member may extend generally in a direction of disposition of the first and second pairs of members in relation to each other. Thus the grippable member may be gripped by a user's hand, e.g. to thereby apply force to the latch, while his hand grips a part of the vehicle. For example the grippable member may, in use, extend alongside the handle bars of a bicycle and the cyclist may grip the grippable member when gripping the handle bars.

The grippable member may define a non-planar profile shaped to engage with a part of the vehicle, such as the handle bars of a bicycle. More specifically the profile may be arcuate, e.g. concave, in form whereby the profile fits around the part of the vehicle. The grippable member may define a grippable portion, the grippable portion defining a part of a cylinder, e.g. such that the grippable portion defines a third to a half of a circumference of a cylinder. The grippable member may comprise a non-slip member which is disposed such that in use the non-slip member abuts against the part of the vehicle. The non-slip member may be formed at least in part of a rubber material or the like which provides for friction between the grippable member and the part of the vehicle. The grippable member may define a non-planar surface, which is configured to engage with a user's hand. More specifically the non-planar surface may comprise plural spaced apart protrusions which interdigitate with the fingers of the user. The protrusions may be ridges, which may extend around a circumference defined by the grippable member.

The latch may comprise a tongue which is movable between a first position, in which the tongue allows for movement of the first and second members between the first and second dispositions, and a second position, in which the tongue resists movement of the first and second members from the first disposition. At least one of the first and second members may comprise a protrusion which is operable to abut against the tongue and thereby resist movement of the first and second members from the first disposition. The latch may be configured for movement of the tongue between the first and second positions by a user operable actuator.

The towing apparatus may further comprise a chassis and the first and second attachment arrangements may be mounted on the chassis. More specifically at least one of the first and second members may be rotatably mounted on the chassis. Alternatively or in addition at least one of the first and second members may be integrally formed with the chassis. The chassis may define a generally hollow rectangular footprint with one side of the rectangle being open.

Further features of the second aspect of the present invention may comprise one or more features of the first aspect of the present invention.

According to a third aspect of the present invention there is provided a towing arrangement comprising a towing part of a cable transport arrangement and towing apparatus according to the first or second aspect of the present invention, the first attachment arrangement of the towing apparatus being fixed to the towing part.

In certain forms the towing part may be configured for towing of objects, such as skiers, over the ground. The towing part may therefore comprise a hanger for a ski tow, such as a hanger for a Poma tow. More specifically a skier engaging part of the hanger, e.g. the button of a Poma tow hanger or the t-bar of a t-bar tow hanger, may be removed and the first attachment arrangement of the towing apparatus may be fixed to the exposed tethering point of the hanger. Further embodiments of the third aspect of the present invention may comprise one or more features of the first or second aspect of the present invention.

According to a fourth aspect of the present invention there is provided a cable transport arrangement comprising at least one towing part and towing apparatus according to the first or second aspect of the present invention, the first attachment arrangement of the towing apparatus being fixed to a towing part.

In certain forms the cable transport arrangement may be configured to tow objects, such as skiers, over the ground. The cable transport arrangement may therefore comprise a tow operable to drag skiers over the ground. Further embodiments of the fourth aspect of the present invention may comprise one or more features of the first or second aspect of the present invention.

The inventor has appreciated that the towing apparatus may be adapted for applications other than towing. One such application may involve stowing a bicycle. Therefore according to a fifth aspect of the present invention there is provided vehicle stowing apparatus, which is configured to bear the weight of a vehicle that can be lifted by a person, the vehicle stowing apparatus comprising:

- a first attachment arrangement configured to be fixed to location spaced apart from the ground, e.g. a ceiling of a room; and
- a second attachment arrangement configured for releasable attachment to the vehicle, the second attachment arrangement comprising first and second substantially rigid members, which are movable in relation to each other between a first disposition in which the first and second rigid members engage with a part of the vehicle to thereby, in use, support the vehicle above the ground, and a second disposition in which the vehicle is released from the vehicle stowing apparatus.

Embodiments of the fifth aspect of the present invention may comprise one or more features of the first aspect of the present invention.

The vehicle stowing apparatus may comprise a latch according to the second aspect of the present invention. However and in contrast to the second aspect the vehicle stowing apparatus may be configured for application of force to disengage the latch. In the absence of an applied force the latch may remain engaged. In the presence of the applied force the latch may disengage and the first and second members may be liable to disengage from the vehicle.

The vehicle stowing apparatus may further comprise a biasing device, such as a spring, which is operative to engage the latch in the absence of an applied force.

The latch may comprise a user operable actuator, which is operable to disengage the latch. The user may be a person operating the vehicle being stowed, e.g. the cyclist where the vehicle is a bicycle. The latch may be configured to require application of force, e.g. against the bias of a biasing device, by way of the user operable actuator to disengage the latch. In the absence of force applied with the user operable actuator the latch may remain engaged.

According to a sixth aspect of the present invention there is provided towing apparatus for towing a vehicle with a cable transport arrangement, the towing apparatus comprising:

- a first attachment arrangement configured to provide for attachment to a towing part of the cable transport arrangement; and
- a second attachment arrangement configured for releasable engagement with a vehicle, the second attachment arrangement comprising first and second substantially rigid grippable arrangements, each of which is movable between a first disposition, in which the grippable arrangement engages with a part of the vehicle and is configured to be gripped together with the part of the vehicle by a user to thereby provide for towing of the vehicle, and a second disposition, in which the grippable arrangement is disengaged from the vehicle.

The towing apparatus according to the sixth aspect of the invention is brought into use by a user, such as a cyclist, moving each of the first and second substantially rigid grippable arrangements from the second disposition to the first disposition. In the second disposition each grippable arrangement is disengaged and may be spaced apart from a part of the vehicle, such as the handle bars of a bicycle. In the first disposition each grippable arrangement engages with a part of the vehicle, such as the handle bars of a bicycle, and is gripped along with the part of the vehicle by the user. Thus, for example, a first grippable arrangement may engage with the left handle bar and a second grippable arrangement may engage with the right handle bar and a cyclist may grip the first grippable arrangement and the left handle bar with his left hand and may grip the second grippable arrangement and the right handle bar with his right hand. When the cyclist wishes to cease towing he releases his grip on the grippable arrangements and the towing apparatus disengages from the bicycle.

At least one of the grippable arrangements may comprise a grippable member. The grippable member may define a non-planar surface which is configured to engage with the part of the vehicle. The non-planar surface may be arcuate, e.g. concave, whereby the grippable member may engage with a convex part of the vehicle. The grippable member may define a part of a cylinder, e.g. such that the grippable member defines a third to a half of a circumference of a cylinder. The grippable member may comprise a non-slip member which is disposed such that in use the non-slip member abuts against the part of the vehicle. The non-slip member may be formed at least in part of a rubber material or the like which provides for friction between the grippable member and the part of the vehicle. The grippable member may define a non-planar surface, e.g. convex surface, which is configured to engage with a user's hand.

At least one of the grippable arrangements may further comprise a base portion, which is mechanically coupled to the grippable member. The grippable arrangement may comprise a joint between the base portion and the grippable member whereby the base portion and the grippable member are movable in relation to each other. The joint may be substantially universal such as may, for example, be provided by a ball joint.

The towing apparatus may further comprise first and second members, e.g. first and second coupling members, which mechanically couple a respective one of first and second grippable arrangements to the first attachment arrangement. At least one of the first and second members may be elongate and pliable to thereby provide for ease of movement of a grippable arrangement. At least one of the first and second members may be resiliently stretchable. A member may be formed at least in part of an elastic material. In use a member may therefore stretch when tension is being taken up at the start of a tow whereby a progressive towing force is applied to the vehicle. The first and second members may be coupled to each other, e.g. they may be formed from one length of elongate member. In addition the first attachment arrangement may comprise an adjustment arrangement, which is configured such that the first and second members depend from the adjustment arrangement. Furthermore the adjustment arrangement is configured for movement of the length of member in relation to the adjustment arrangement whereby relative lengths of the first and second members may be changed. More specifically the adjustment arrangement may define a channel which is configured to receive and to allow for substantially free movement of the length of member in the channel. At least one of the first and second members may comprise a flange, which is configured to abut against the first attachment arrangement. The flange may be disposed on the member so as to limit an extent to which the member may be shortened by movement relative to the first attachment arrangement. Further embodiments of the sixth aspect of the present invention may comprise one or more features of any previous aspect of the present invention. According to further aspects of the invention there may be a towing arrangement according to the third aspect or a cable transport arrangement according to the fourth aspect which comprises towing apparatus according to the sixth aspect of the present invention.

BRIEF DESCRIPTION OF DRAWINGS

The present invention will now be described by way of example only with reference to the following drawings, of which.

DESCRIPTION OF EMBODIMENTS

Figure 1:
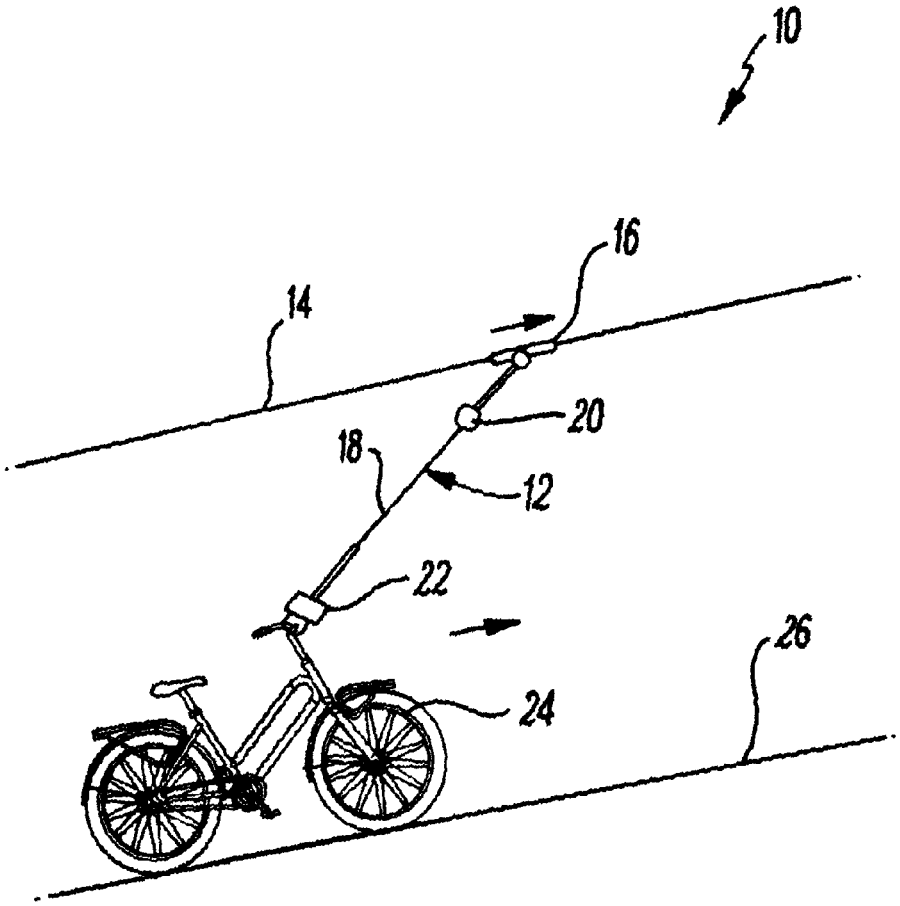
FIG. 1 shows a bicycle being towed by a Poma tow according to the present invention.

FIG. 1 shows a Poma tow 10 (which constitutes a cable transport arrangement) which is modified for towing of bicycles instead of skiers. The Poma tow 10 comprises plural hangers although only one hanger 12 (which constitutes a towing part) is shown in FIG. 1. In accordance with known design the Poma tow comprises a cable 14, which is drawn in the direction indicated by the arrows, with the hanger 12 being attached to the cable by a clamping device 16 such that the hanger moves with the cable. The hanger 12 comprises a length of rope 18 which is attached to the clamping device 16 by way of a tensioning device 20, which is operative to retract spare rope. Ordinarily the distal end of the rope 18 is terminated with a button which the skier places between his legs. According to the arrangement of FIG. 1 the button is removed to expose the threaded bolt to which the button is secured. Towing apparatus 22 is fixed to the bolt as described further below with reference to FIGS. 2A and 2B. In an alternative form of hanger a short length of rope at the end of the hanger is received in an aperture in the button and a knot is formed in the rope underneath the button to hold the button in place. With this alternative form of hanger the rope is unknotted and then tied to the ring 44 (which is described below with reference to FIG. 2A). Thus the button remains in place and the towing apparatus is attached to the hanger underneath the button to thereby permit use by both skiers and cyclists. The towing apparatus 22 releasably engages with the handle bars of a bicycle 24 (which constitutes a vehicle) whereby and upon operation of the Poma tow 10 the bicycle 24 is towed over the ground 26 in the direction shown by the arrows.

Figure 2A:
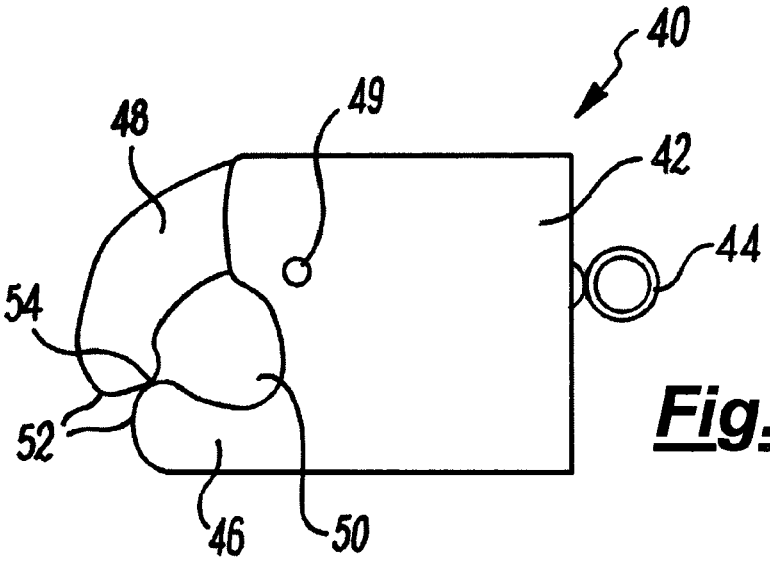
FIG. 2A is a side view of towing apparatus according to the present invention.
Figure 2B:
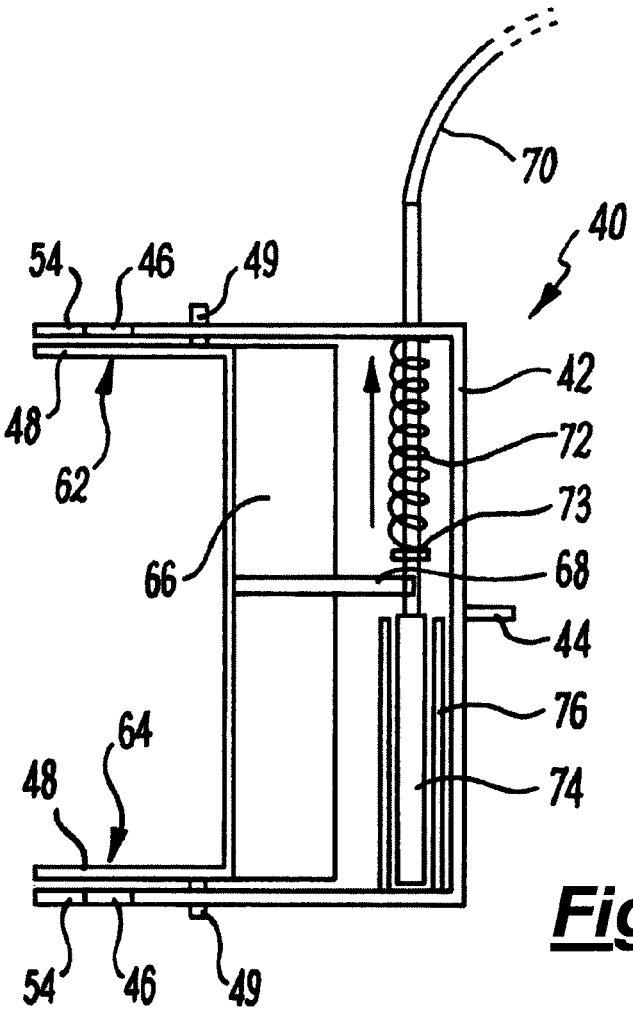
FIG. 2B is a plan view from above of the towing apparatus of FIG. 2A.

A side view of the towing apparatus of FIG. 1 is shown in FIG. 2A. The towing apparatus 40 comprises a chassis 42 to which a ring 44 (which constitutes a first attachment arrangement) is attached securely, e.g. by welding where the chassis and ring are formed of metal or by fusion or integral moulding where the chassis and ring are formed of a rigid plastics material, such as Nylon 66. The exposed bolt of the hanger of FIG. 1 is passed through the ring 44 and a nut of greater diameter than the internal diameter of the ring is threaded on to the end of the bolt to attach the towing apparatus 40 securely to the hanger. Towing apparatus 40 as shown in FIGS. 2A and 2B is attached to the end of each of the plural hangers of the Poma tow 10. At the end opposite the ring 44 the chassis defines a first jaw 46. The towing apparatus 40 further comprises a second jaw 48, which is mounted for rotation on the chassis at a pivot point 49 near the base of the first jaw 46. Rotation of the second jaw 48 in relation to the first jaw 46 provides for movement between a first disposition (as shown in FIG. 2A) in which the jaws are closed and a second disposition in which the jaws are open. The first and second jaws constitute a second attachment arrangement. As can be seen from FIG. 2A, the first and second jaws define a generally circular aperture 50 when in the first disposition. A distal edge 52 of each of the first and second jaws 46, 48 defines an arcuate profile. The function of the distal edges 52 is described below. When the first and second jaws 46, 48 are in the second disposition their opposing edges 54 are sufficiently far apart to enable the jaws to be located around a part of a bicycle, such as the handle bars.

A plan view of the towing apparatus 40 of FIG. 2A is shown in FIG. 2B. Components of FIG. 2B common to FIG. 2A are designated by like reference numerals. As can be seen from FIG. 2B the towing apparatus 40 comprises a first pair of jaws 62 and a second pair of jaws 64. Each of the first and second pair of jaws 62, 64 are formed as described above with reference to FIG. 2A and subject to the following description. The chassis 42 defines an open sided hollow rectangle when viewed from above. The first, lower jaw 46 of each pair is defined by opposite arms of the rectangle defined by the chassis. The towing apparatus 40 also comprises a jaw arrangement 66, which defines an open sided hollow rectangle, with the jaw arrangement 66 being received in the rectangular space defined by the chassis 42 and such that the open end of the jaw arrangement 66 faces in the same direction as the open end of the chassis. The jaw arrangement 66 is pivotally attached to the chassis 42 at pivot points 49, which are at opposite locations on the jaw arrangement and the chassis. Opposite arms of the jaw arrangement 66 define the second jaws 48 of the first and second pairs of jaws. The jaw arrangement 66 pivots in relation to the chassis 42 to move the first and second jaws 46, 48 of each pair of jaws between the first, closed and second, open dispositions. The jaw arrangement 66 also comprises a protrusion 68, which extends in an opposite direction to the second jaws 48 towards the base of the rectangle defined by the chassis 42. The chassis and the jaw arrangement are formed of a strong, rigid material, such as metal or a plastics material, such as Nylon 66.

The towing apparatus further comprises a latch arrangement, which comprises a user grippable elongate member 70, a coil spring 72 (which constitutes a biasing device) and a tongue 74. A proximal end of the user grippable elongate member 70 passes through an aperture formed in a side of the chassis 42 and is attached to the side of the tongue 74. The distal end of the user grippable elongate member 70 extends laterally of the chassis. The user grippable elongate member 70 comprises a pliable yet stiff material, such as a multi-strand metal cable, whereby the user grippable elongate member 70 extends in a desired lateral direction but may be bent for convenience of use. The coil spring 72 is disposed around the elongate member 70 and bears between an inside surface of the chassis 42 and a flange 73 extending from the elongate member near to the junction between the elongate member 70 and the tongue 74. The tongue 74 is generally rectangular in footprint when viewed from the side (instead of the plan view shown in FIG. 2A) and the elongate member 70 is attached to an end of the tongue towards its base such that the main part of the tongue extends away from the axis of the elongate member 70 towards the top of the chassis (i.e. out of the page in the view provided by FIG. 2B). More specifically the upper edge of the tongue (as seen in FIG. 2B) slopes downwards slightly (i.e. into the page of the plan view of FIG. 2B) as one progresses along the upper edge of the tongue towards the coil spring. The tongue 74 is held in a channel 76 on the opposite side of the protrusion 68 to the coil spring 72. More specifically the top of the edge of the tongue 74 lies slightly below and to one side of the bottom edge of the protrusion 68 when the jaws are in the first (i.e. closed) disposition. When the jaws are in the second (i.e. open) disposition, the protrusion rotates downwards such that the side of the tongue 74 facing the coil spring 72 is adjacent a side of the protrusion 68, whereby abutment of the side of the tongue against the side of the protrusion prevents movement of the tongue by the elongate member 70 thereby preventing the jaws being locked when in the second, open disposition.

During use, as described further below, the user grips the free end of the elongate member 70 and applies a force, which withdraws the elongate member through the aperture in the chassis against the bias of the coil spring 72. Withdrawal of the elongate member 70 when the jaws are in their first, closed disposition moves the tongue 74 such that the top of the edge of the tongue 74 lies slightly below the bottom edge of the protrusion 68. Movement of the jaws from the first, closed disposition to the second, open disposition is arrested when the bottom edge of the protrusion 68 abuts against the top of the edge of the tongue 74. If the user releases his grip on the free end of the elongate member 70 the bias of the coil spring 72 is operative to return the tongue 74 to its starting position whereby the tongue presents no obstacle to movement of the jaw arrangement 66. Thus the jaws can move freely between their first and second dispositions. Thus it can be appreciated that a user needs to apply and to continue applying a force to the elongate member if he wishes to maintain the jaws in their first, closed disposition. In the event of failure of the coil spring 72 or a reduction in the spring constant of the coil spring, e.g. through ageing of the coil spring, such that the coil spring fails to apply a bias or sufficient bias to the tongue 74, the protrusion 68 tends to ride down the sloping upper edge of the tongue to thereby provide for movement from the first, closed disposition to the second, open disposition. Withdrawal of the elongate member 70 when the jaws are in their second, open disposition moves the tongue 76 such that the side of the tongue facing the coil spring abuts against a side of the protrusion thereby arresting further withdrawal of the elongate member 70.

Figure 3:
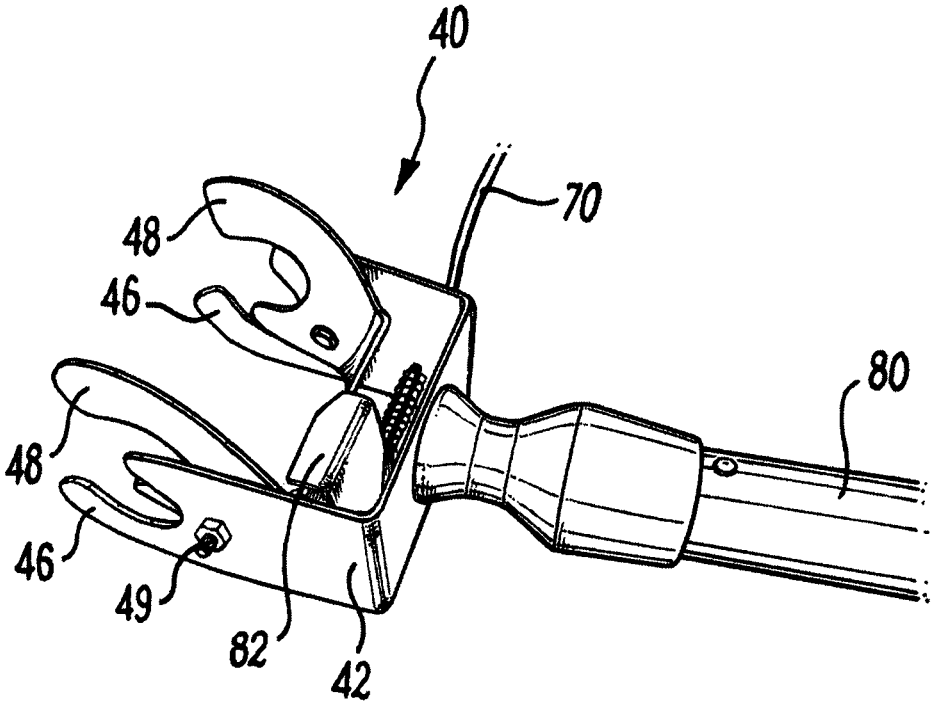
FIG. 3 is a photograph of towing apparatus according to the present invention.

FIG. 3 is a photograph of the towing apparatus 40 when attached to a hanger 80 and when viewed in perspective and from above. Components of FIG. 3 common to FIGS. 2A and 2B are designated by like reference numerals. The embodiment of FIG. 3 comprises a cover 82, which is absent from the embodiment of FIG. 2B. The cover 82 extends up from the channel 76 of the embodiment of FIG. 2B and parallel to a side of the tongue before turning through ninety degrees and extending over the top of the tongue. The cover 82 therefore shields the tongue, reduces the likelihood of movement of the tongue being impeded and constrains its movement to thereby provide for its proper operation.

The use of the towing apparatus will now be described with reference to the Figures. Towing apparatus 22, 40 is fixed to the end of at least one hanger of a Poma tow 10 as described above. When a cyclist wishes to use the Poma tow 10 he grasps the towing apparatus 22, 40 and directs the distal ends of the jaws 46, 48 of the towing apparatus 22, 40 towards the handle bars of his bicycle 24. The cyclist then urges the distal edges 52 of the jaws 46, 48 against the handle bars whereby the arcuate surface profiles of the distal edges 52 engage with the handle bars and thereby prise the jaws apart. Further movement of the towing apparatus 22, 40 causes the handle bars to be received in the space between the open jaws. When the handle bars bear against the proximal surface of the jaws, which defines part of the handle bar receiving space, the jaws are forced closed such that they encircle the handle bars. The free end of the elongate member 70 now extends generally parallel to one of the handle bars. The cyclist then grabs the free end of the elongate member 70 and applies a force to thereby prevent the jaws from opening. He then grips the handle bar and the elongate member 70 at the same time with one of his hands to thereby maintain application of force to the elongate member 70. The cyclist maintains his grip on the elongate member 70 while he and his bicycle 24 are drawn over the ground by the Poma tow 10. When the cyclist wishes to leave the Poma tow 10 he releases his grip on the elongate member 70, the jaws 46, 48 are urged open by the force applied to the inside surface of the jaws by the handle bars and the bicycle 24 is released by the towing apparatus 22, 40. If the cyclist is unable to maintain his grip on the handle bars, e.g. if he loses balance, loss of handle bar grip is accompanied by loss of grip of the elongate member whereby the bicycle 24 is released by the towing apparatus 22, 40.

Figure 4:
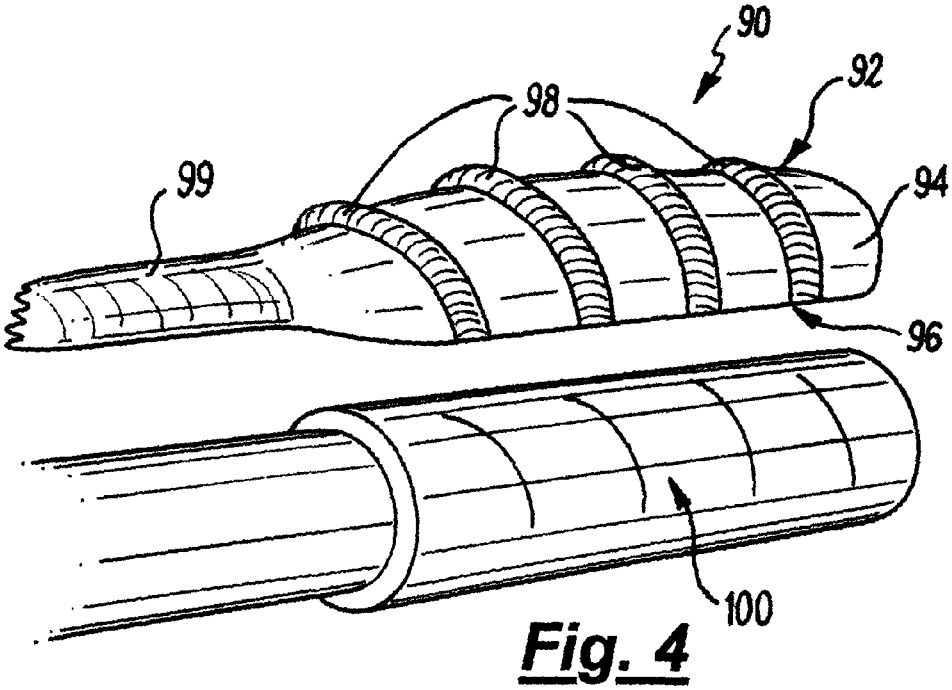
FIG. 4 is a sketch of an alternative embodiment of grippable member.

FIGS. 2B and 3 show an elongate user grippable member 70. An alternative embodiment of grippable member 90 is shown in FIG. 4. The grippable member 90 comprises a grippable portion 92, which forms a part of a cylinder such that it defines a convex upper surface 94 and a concave lower surface 96. Although not shown in FIG. 4 the concave lower surface is coated with rubber to thereby provide a high friction surface. Plural spaced apart protrusions 98 in the form of ridges extend around the partial circumference defined by the upper surface 94 of the grippable member 92. The grippable member 90 is attached to the end of an elongate member 99, which is otherwise formed and functions as per the elongate grippable member as shown in FIGS. 2B and 3. In use the grippable member 90 of FIG. 4 is brought into engagement with the handle bars 100 of a bicycle such that the rubber coating on the concave lower surface 96 abuts against the handle bars 100. The rubber coating provides for friction between the grippable member 90 and the handle bars 100. The user grips the grippable member 90 such that his fingers interdigitate with the ridges 98 on the convex upper surface 94 to thereby provide for improved grip.

Figure 5:
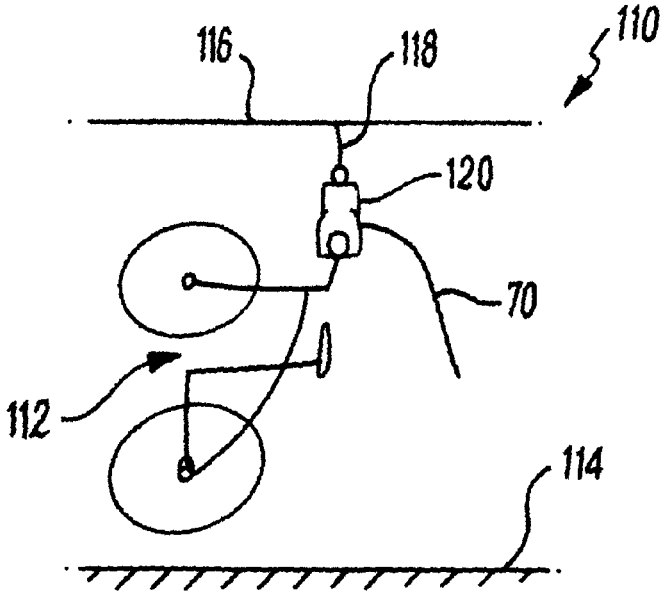
FIG. 5 is a sketch of the towing apparatus of FIGS. 1 to 3 as adapted for stowing a bicycle.

A sketch of the towing apparatus of FIGS. 1 to 3 after its adaption as stowing apparatus for use in stowing a bicycle 110 is shown in FIG. 5. As can be seen from FIG. 5, a bicycle 112 is suspended above the ground 114 from a roof 116, e.g. of a building such as a garage. A rigid elongate member 118, such as a metal bar, is attached securely at a first end to the roof 116 and is attached securely at a second opposite end to the ring of the stowing apparatus (see the ring of the towing apparatus shown in FIG. 2A). The second end of the elongate member 118 is attached to the ring, for example, by passing the elongate member 118 through the ring and threading a nut onto the free end of the elongate member. Before describing the operation of the stowing apparatus 120 its adaption from the towing apparatus of FIGS. 1 to 3 will now be described. Referring now to FIG. 2B the coil spring 72 is removed from its location within the space defined by the chassis 42. In addition the part of the elongate member 70 that extends beyond the chassis 42 is removed apart from a length of about 2 cm. The coil spring is fitted over the remaining length of the elongate member and a flange is attached at the end of the remaining length of the elongate member whereby the coil spring applies a bias between the chassis and the flange which is operative to bias the tongue 74 towards the engaged position. A second aperture is provided at a side of the chassis 42 opposite the present aperture; as described above the present aperture provides for passage of the elongate member through the side of the chassis. The detached part of the elongate member 70 is then passed through the second aperture and is attached to the side of the tongue facing the second aperture. The elongate member 70 is therefore operative upon application of a force by a user, such as a cyclist, against the bias of the coil spring to disengage the tongue and allow the jaws to open. In use, the cyclist pulls the elongate member to allow for unhindered opening of the jaws and positions the handle bars of the bicycle 112 between the open jaws of the stowing apparatus 120. The jaws are allowed to close around the handle bars whereupon a lack of force applied by the cyclist to the elongate member allows the tongue to engage by virtue of the bias applied by the coil spring whereby the jaws are locked in the closed position. The bicycle is released from its stowed position by pulling on the elongate member 70 whereby the jaws are permitted to open to thereby release the bicycle.

Figure 6:
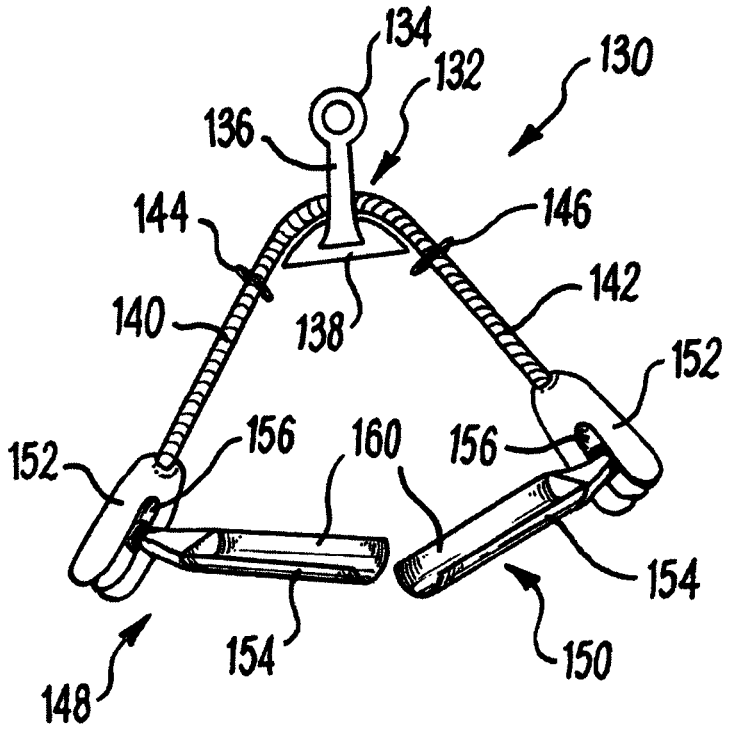
FIG. 6 is a sketch of an alternative embodiment of towing apparatus.

A sketch of an alternative embodiment of towing apparatus 130 is shown in FIG. 6. The towing apparatus comprises a first attachment arrangement 132, which in turn comprises a ring 134, which is attached to one end of a base frame 136. As can be seen from FIG. 8, the base frame defines a generally rectangular aperture. The first attachment arrangement 132 further comprises an adjustment arrangement 138 which defines a channel. The adjustment arrangement 138 is attached to an opposing end of the base frame 136 to the ring 134 such that the channel is located in the aperture defined by the base frame 136 and such that the channel defines in part a lower boundary to the aperture. The towing apparatus further comprises first 140 and second 142 elongate members which are formed from a single length of resiliently stretchable material. The length of resiliently stretchable material is fed through the aperture defined by the base frame 136 and such that it is received in the channel defined by the adjustment arrangement 138. A first flange 144 is fixedly attached to the first elongate member 140 at a location spaced apart from the first attachment arrangement and a second flange 146 is fixedly attached to the second elongate member 142 at a location spaced apart from the first attachment arrangement. The first and second flanges 144, 146 are located on their respective elongate members to limit an extent to which the length of resiliently stretchable material can pass through the aperture defined by the base frame to thereby limit an extent to which the relative lengths of the first and second elongate members can be changed.

The towing apparatus 130 further comprises a first grippable arrangement 148 and a second grippable arrangement 150. Each of the first and second grippable arrangements 148, 150 comprises a base portion 152 and a rigid grippable member 154. Each base portion 152 is attached to an end of a respective one of the first and second elongate members 140, 142. Each grippable member 154 is attached to a respective one of the two base portions 152 by way of a universal joint 156, which provides for freedom of relative movement of base portion 152 and grippable member 154. The joint 156 is shown in more detail in FIG. 9. Each grippable member defines a concave surface 160 which is configured to engage with the handle bars of a bicycle. The grippable member is formed such that it defines half a cylinder. A non-slip member (not shown), which is formed of rubber, is disposed on the concave surface such that in use the non-slip member abuts against the part of the vehicle and thereby provides for friction between the grippable member and the handle bars.

Figure 7:
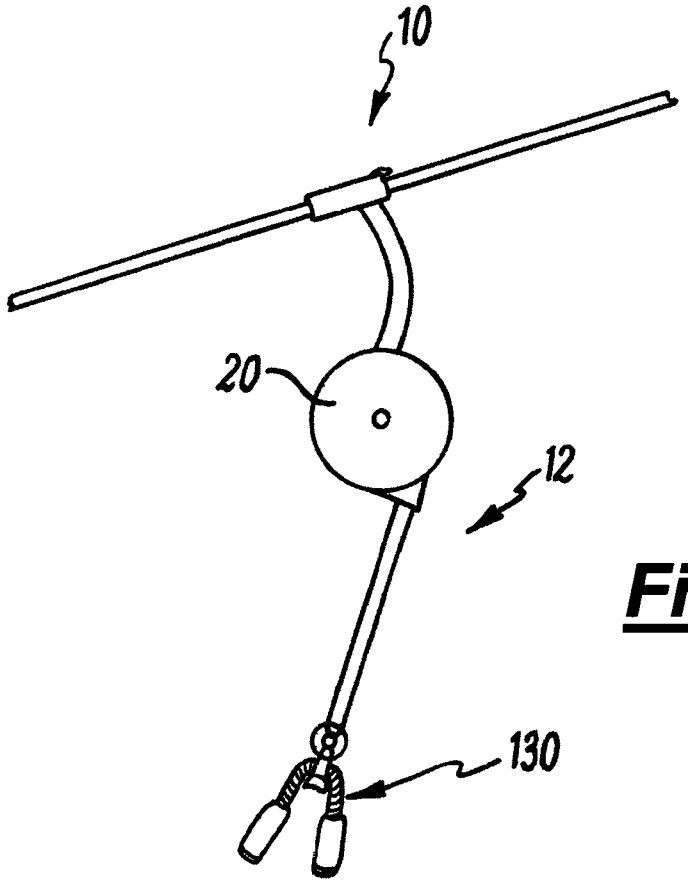
FIG. 7 is a sketch of the embodiment of FIG. 6 attached to a ski tow.

The towing apparatus of FIG. 6 is shown attached to a ski tow in FIG. 7. Components of FIG. 7 in common with FIGS. 1 and 6 are designated by like reference numerals. The towing apparatus 130 is attached to the end of the hanger 12 in the same fashion as is described above with reference to FIG. 1.

Figure 8:
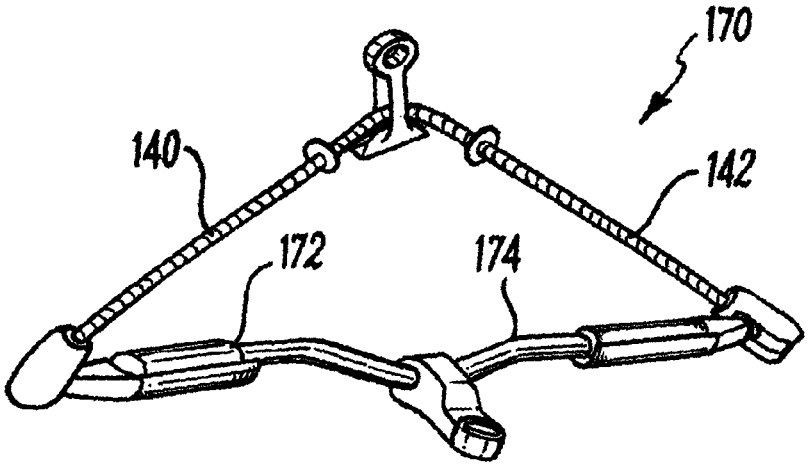
FIG. 8 is a sketch showing the embodiment of FIG. 6 engaged with the handle bars of a bicycle.

Use of the towing apparatus of FIGS. 6 and 7 will now be described with reference to FIG. 8, which shows the towing apparatus engaged with the handle bars 172, 174 of a bicycle. Components of FIG. 8 in common with FIG. 6 are designated by like reference numerals. A cyclist positions himself when on his bicycle close to the ski tow. As a hanger, which bears towing apparatus 130, 170, passes him he grabs the first and second grippable members 154, separates the grippable members and places one of the grippable members underneath the left handle bar 172 and the other of the grippable members underneath the right handle bar 174. The cyclist then grips the left handle bar 172 and its engaged grippable member with his left hand and grips the right handle bar 174 and its engaged grippable member with his right hand. As the hanger moves the tension in the first and second elongate members 140, 142 increases whereby the force exerted by the towing apparatus 130, 170 on the bicycle gradually increases as the first and second elongate members stretch. Thus the speed of movement of the bicycle over the ground increases until it matches the speed of movement of the hanger. When the cyclist wishes to cease towing or when the cyclist encounters a problem, such as over-balancing on his bicycle, he releases his grip on the grippable members 154. Upon the release of grip the grippable members 154 disengage from the handle bars to thereby release the bicycle.

Figure 9:
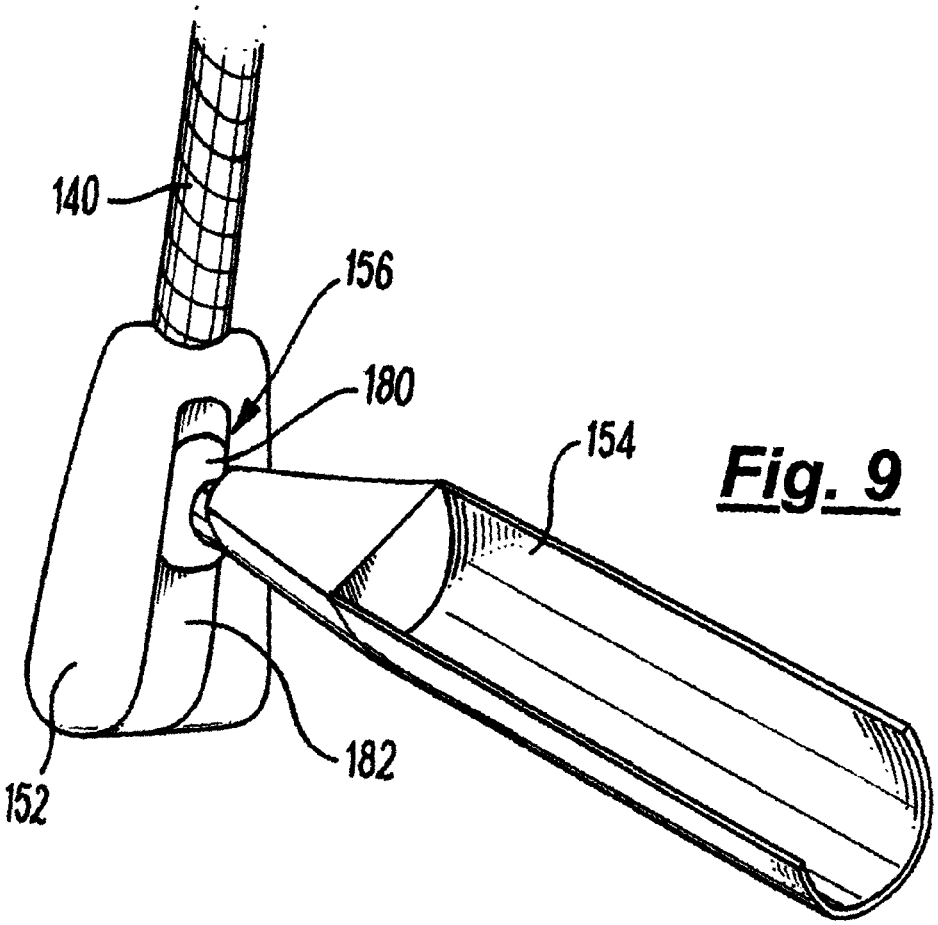
FIG. 9 is a sketch of a detailed view of the joint between the grippable member and the base portion of the embodiment of FIG. 6.

A detailed view of the joint 156 between the grippable member 154 and the base portion 152 of the towing apparatus FIG. 6 is shown in FIG. 9. Components of FIG. 9 in common with FIG. 6 are designated by like reference numerals. As can be seen from FIG. 9 the grippable member comprises a ball 180 at its proximal end. The ball 180 is received in a socket 182 defined by the base portion 152 to thereby form a universal joint between the grippable member and the base portion.

Figure 10A:
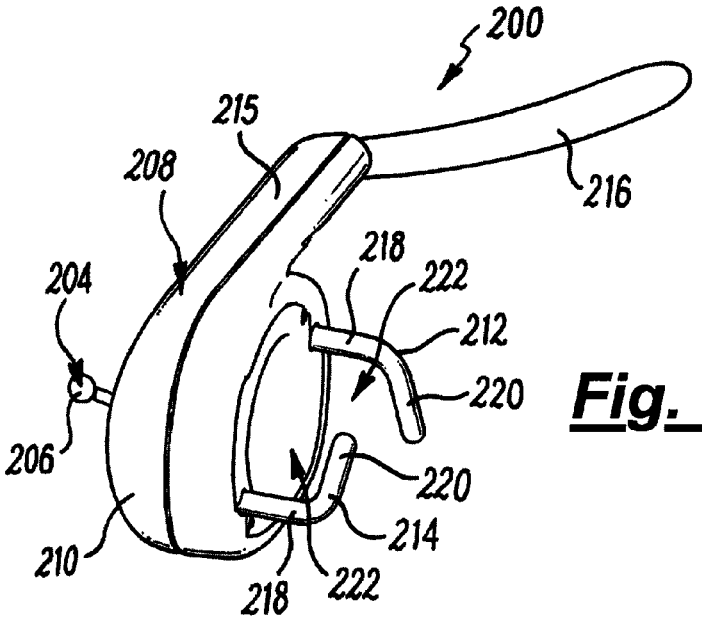
FIG. 10A shows a further embodiment of towing apparatus.
Figure 10B:
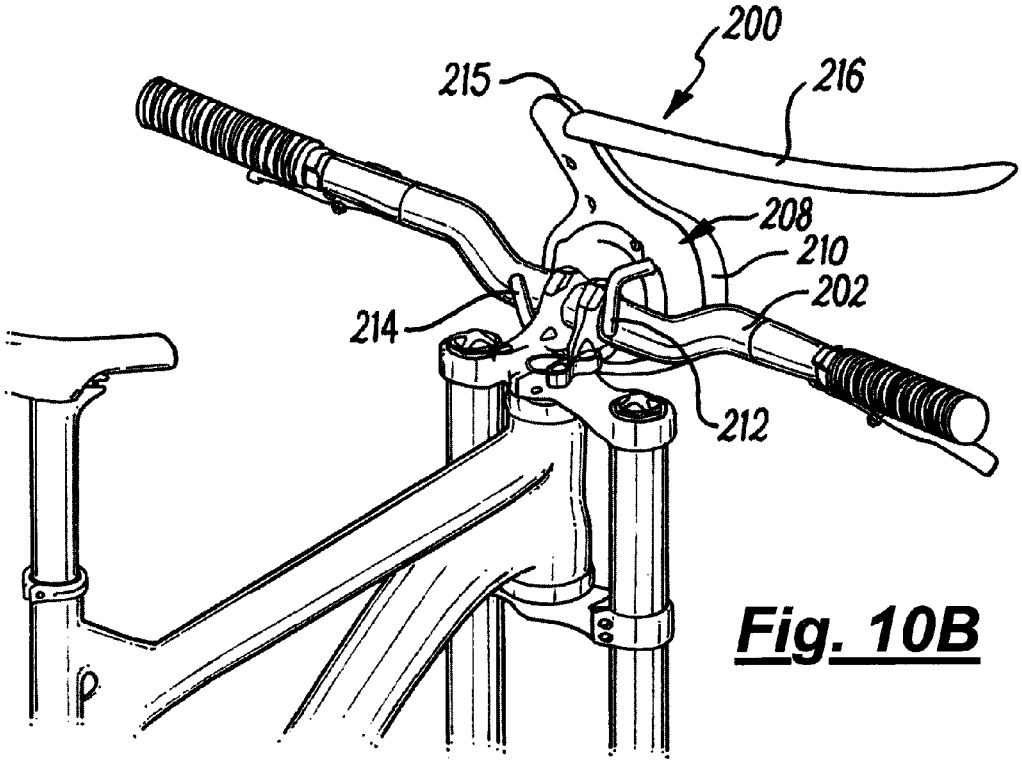
FIG. 10B is a view of the embodiment of FIG. 10A when in use.

A further embodiment of towing apparatus 200 will now be described with reference to FIGS. 10A and 10B. FIG. 10A shows the further embodiment 200 when detached from a bicycle and FIG. 10B shows the embodiment when engaged with the handlebars 202 of a bicycle. The further embodiment of towing apparatus 200 comprises a first attachment arrangement 204, which is formed of metal and defines an aperture 206 which provides for attachment to a hanger of a ski tow as described above with reference to FIGS. 1 to 2B.

In an alternative form the first attachment arrangement comprises a cylindrical body and a circular disc attached to a distal end of the cylindrical body, with the circular disc being of greater diameter than the cylindrical body. A portion of the cylindrical body at its proximal end has a thread formed thereon. A bore is formed in the alternative form of first attachment arrangement such that the bore extends though the disc and axially along the cylindrical body before changing direction by about ninety degrees before the threaded portion starts and finally exiting through a side of the cylindrical body. The alternative form of first attachment arrangement is formed separately from the second attachment arrangement from an appropriate metal, such as steel or brass. The alternative form of first attachment arrangement is attached to the second attachment arrangement by threading the threaded proximal portion of the cylindrical body of the first attachment arrangement into a threaded bore formed in the main body of the towing apparatus. The alternative form of first attachment arrangement is suitable for use with a hanger of a ski tow comprising a length of rope. In use an end of the length of rope is passed through the bore formed in the alternative form of first attachment arrangement until the end of the rope protrudes beyond the bore exit at the side of the cylindrical body. The protruding end is then knotted to form a knot of larger diameter than the bore exit to prevent withdrawal of the rope and thereby attach the towing apparatus to the hanger.

The further embodiment of towing apparatus 200 further comprises a second attachment arrangement 208 to which the first attachment arrangement 204 is attached by way of a bolt and nut arrangement (not shown). The second attachment arrangement 208 comprises a main body 210, a first arm 212 and a second arm 214. The second attachment arrangement 208 further comprises a metal chassis (not shown) to which a cover is fitted such that the cover encloses the metal chassis. The metal chassis is formed from stainless steel. The cover comprises first and second parts which fit together around the metal chassis. The diameter of the cover is about 120 mm. The cover is formed from high density polyethylene (HDPE) or polypropylene. The first arm 212 and the second arm 214 are formed from stainless steel and are each removably attached to the metal chassis by way of bolts or are permanently attached by welding. The main body is generally disc shaped with the first and second arms 212, 214 extending from near opposite edges of a base of the main body on an opposite side of the main body to the first attachment arrangement 204. The first attachment arrangement 204 is attached at the side of the main body such that a towing force is exerted between the first and second arms 212, 214. The main body 210 is shaped to define a rigid protruding member 215 which extends laterally from the rest of the main body in a direction orthogonal to an axis about which the first and second arms rotate between the first and second positions. A proximal end of the rigid protruding member 215 is located such that it is between the two arms but spaced apart from a line between the two arms. The distance between the distal end of the rigid protruding member 215 a location between the two arms is about 180 mm. The rigid protruding member 215 is about 140 mm long. The rigid protruding member 215 is shaped such that its distal end is below the furthest reach of the first and second arms 212, 214 and such that, in use, its distal end is closer to the bicycle rider than its proximal end. The further embodiment of towing apparatus 200 further comprises a handle 216 which is attached at one end towards the distal end of the rigid protruding member 215 such that the handle 216 extends away from the main body 210 in generally a same direction as a relative disposition of the two arms. The handle 216 is comprised of a substantially entirely pliable portion formed from dip moulding of an ultraviolet (UV) resistant grade of polyvinylchloride (PVC). An alternative form of handle is described below with reference to FIGS. 11A to 11C. As will become apparent from the description below the handle of FIGS. 11A to 11C comprises a rigid proximal portion and a pliable distal portion whereby there is no need for the rigid protruding member 215 of FIGS. 10A and 10B. The main body 210 of FIGS. 10A and 10B is therefore formed without the rigid protruding member 215 and the handle of FIGS. 11A to 11C is attached to the same location on the main body as the now absent rigid protruding member.

As can be seen from FIG. 10A each of the first and second arms 212, 214 comprises a proximal portion 218 and a distal portion 220. The proximal portions 218 extend linearly from the base of the main body in a direction away from the first attachment arrangement. The arms are then angled such that the distal portions 220 extend in directions a little off parallel to the base of the main body. Each of the first and second arms 212, 214 extends away from the base of the main body by a distance of about 45 mm. Each distal portion 220 extends by about 35 mm in a direction parallel to the base of the main body. As can be seen from FIG. 10A the distal portions 220 of the first and second arms 212, 214 extend in opposite directions. A surface of each of the first and second arms 212, 214 which faces in the direction followed by the arms defines a vehicle engaging profile with the two vehicle engaging profiles being substantially the same albeit differently directed. Each of the surfaces with the main body defines a recess 222 which is shaped to fit around a handlebar of a bicycle. A surface of each distal portion 220 which forms part of the vehicle engaging profile at an angle of between substantially 110° and substantially 115° to its proximal portion. Normally the towing force lies on a longitudinal axis (which constitutes an attachment arrangement axis) of the towing apparatus 200 which extends from the first attachment arrangement 204 through the second attachment arrangement 208. An end of each distal portion 220 has a width of 10 mm and a height of 10 mm whereby the end of the distal portion can fit between the handlebars and the upper triple clamp of a bicycle.

The towing apparatus 200 of FIGS. 10A and 10B is brought into use by orienting the second attachment arrangement 208 by way of the rigid protruding member 215 such that the handlebars 202 can be received between the first and second arms 212, 214. This orientation of the second attachment arrangement constitutes the first position in which the vehicle engaging profiles can be brought into engagement with the handlebars of the bicycle. Then the user rotates the second attachment arrangement about the attachment arrangement axis through between substantially 70° and substantially 75° such that each handlebar 202 is moved relative the arms such that it abuts against the part of the surface of an arm which defines the recess 222. This present orientation of the second attachment arrangement constitutes the second position in which the vehicle engaging profiles engage with handlebars of the bicycle so as to provide for towing of the bicycle. During towing the handlebars 202 bear against the vehicle engaging surface of the distal portions 220 of the first and second arms 212, 214. During towing the cyclist grips the handle 216 against one of the handlebars 202 and thereby prevents the towing force from moving the second attachment arrangement 208 from the second position to the first position to prevent the second attachment arrangement 208 from disengaging from the handlebars 202. The form, function and use of the embodiment of FIGS. 10A and 10B are otherwise as described in respect of the other embodiments.

Figure 11A:
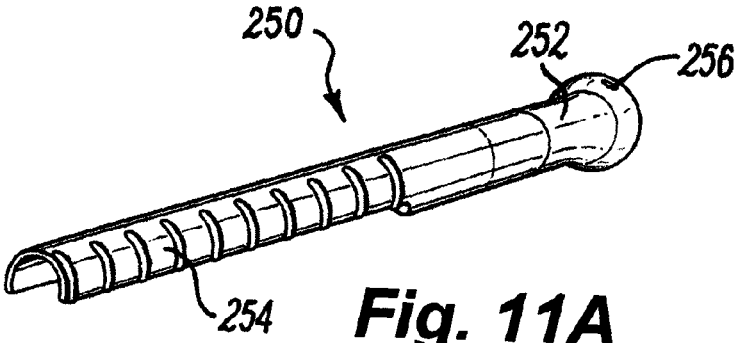
FIG. 11A shows an alternative form of handle to the handle shown in FIGS. 10A and 10B.
Figure 11B:
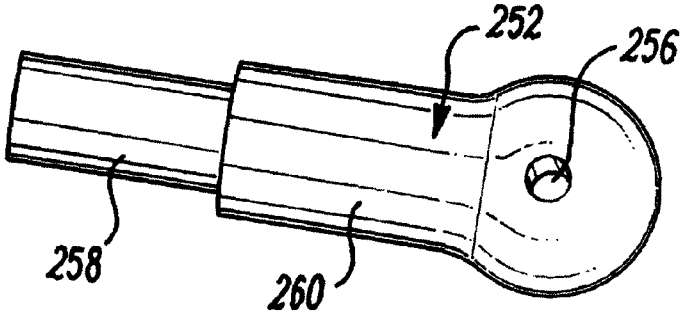
FIG. 11B shows the rigid portion of the handle of FIG. 11A.
Figure 11C:
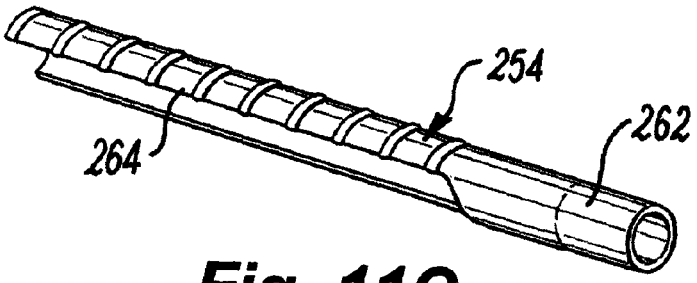
FIG. 11C shows the pliable portion of the handle of FIG. 11A.

An alternative form of handle to the handle shown in FIGS. 10A and 10B is shown in FIG. 11A. The handle 250 of FIG. 11A is between 420 mm and 470 mm long and comprises a rigid portion 252 and a pliable portion 254 which extends from an end of the rigid portion. As described above the presence of the rigid portion 252 makes the rigid protruding member 215 of FIGS. 10A and 10B unnecessary. As will become apparent from the description of FIGS. 11B and 11C a proximal portion of the pliable portion fits over a distal portion of the rigid portion. A bore 256 is defined in the proximal portion of the rigid portion 252. The handle 250 is attached to the top of the main body 210 at the location of the now absent rigid protruding member 215 shown in FIG. 10A by means of a bolt (not shown) which is threaded through the bore 256 and a bore formed in the metal chassis of the main body 210. The handle 250 when so attached is positioned so that it is at a particular angle to the main body before being fixed with a nut which is threaded on the bolt and tightened so as to prevent movement of the handle in relation to the main body. In other forms the rigid portion has a non-bulbous, cylindrical proximal portion which is received in a bore formed in the main body. In such forms the proximal portion is attached to the main body by adhesion or by welding. Alternatively the proximal portion defines a bore in its end face and is pushed through bore formed in the main body until it abuts against the opposing face of the main body where a further bore is formed, with the further bore being in registration with the bore in the end face. The further bore and the bore formed in the end face of the proximal portion receive a bolt from outside the main body to thereby attach the handle securely to the main body. As mentioned above the handle 250 is set at a particular angle to the main body. More specifically the rigid portion 252 of the handle 250 is at an angle of between substantially 95° and 135° to a direction of the towing force on the towing apparatus. In use the cyclist grips the rigid portion 252 when bringing the second attachment arrangement 210 into engagement with the handlebars 202 and when moving the second attachment arrangement from the first position to the second position. Then the cyclist moves his grip from the rigid portion 252 to the pliable portion 254 and holds the pliable portion against one of the handlebars as he grips the handlebar. As mentioned above, the holding of the pliable portion against the handlebar applies a restraining force to the second attachment arrangement 210 which prevents the second attachment arrangement from disengaging from the handlebars as the bicycle is towed.

The rigid portion 252 of the handle 250 of FIG. 11A is shown in FIG. 11B. As can be seen from FIG. 11B the distal portion 258 of the rigid portion is of smaller diameter than the proximal portion 260 of the rigid portion. The rigid portion is formed of a plastics material, such as ABS. The rigid portion is about 120 mm long. The pliable portion 254 of the handle 250 of FIG. 11A is shown in FIG. 11C. The pliable portion is formed of EVA and is between 300 mm and 350 mm long. A proximal portion 262 of the pliable portion 254 is tubular in form and formed such that the narrow distal portion 258 of the rigid portion is received in an end of the proximal portion 262 of the pliable portion. The rigid and pliable portions 252, 254 are securely attached to each other by way of adhesive which is applied to the interior surface of the proximal portion 262 of the pliable portion and to the exterior surface of the narrow distal portion 258 of the rigid portion. As can be seen from FIG. 11C a distal portion 264 of the pliable portion is hem i-cylindrical in form whereby the curved inner and outer surfaces of the distal portion 264 conform more readily to the shape of the handlebar and the cyclist's grip.

Figure 12:
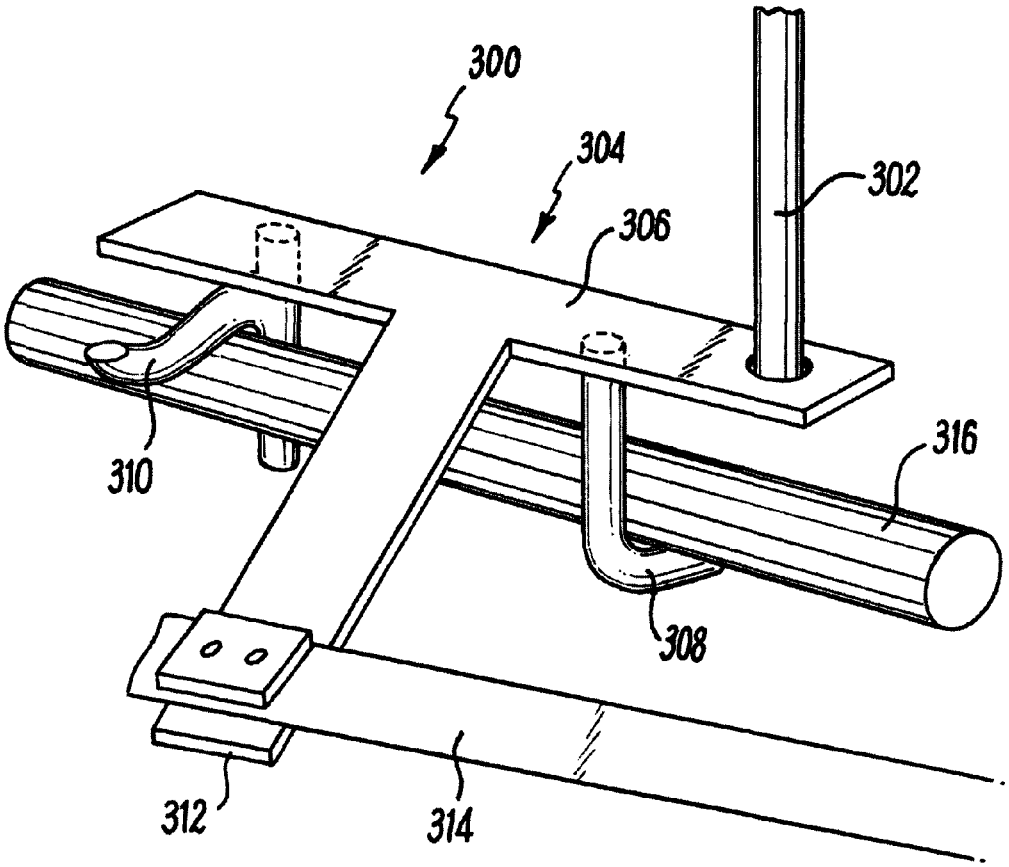
FIG. 12 shows a yet further embodiment of towing apparatus in situ on handlebars of a bicycle.

A yet further embodiment of towing apparatus 300 is shown in FIG. 12 in situ on handlebars of a bicycle. The towing apparatus 300 comprises a first attachment arrangement 302 and a second attachment arrangement 304. The second attachment arrangement 304 also comprises a main body 306 to which a first arm 308 and a second arm 310 are attached. The towing apparatus 300 further comprises a rigid protruding member 312 and a handle 314. The handle 314 is substantially entirely pliable and is formed from dip moulding of an ultraviolet (UV) resistant grade of polyvinylchloride (PVC). The handle 314 is attached at one end, for example, by way of a nut and bolt, towards a distal end of the rigid protruding member 312. The first attachment arrangement 302 is configured to provide for attachment to a hanger of a cable transport arrangement. As shown in FIG. 12 a wire cable which bears a metal hoop (not shown) at its distal end is attached at its proximal end to the main body 306 by soldering, a nut and bolt arrangement or the like. The first attachment arrangement 302 may instead have any of the alternative forms described above with reference to previous embodiments.

The first and second arms 308, 310, which are described further below with regards to their form and function, are attached to the opposite side of the main body 306 to the first attachment arrangement 302. The first and second arms 308, 310 are attached to the main body 306 by soldering, a nut and bolt arrangement or the like. The rigid protruding member 312 is integrally formed with the main body 306 and extends from the main body midway between the proximal ends of the first and second arms 308, 310. The main body 306, the first and second arms 308, 310 and the rigid protruding member 312 are formed from stainless steel. Although not shown in FIG. 12 the main body 306, the proximal ends of the first and second arms 308, 310 and the rigid protruding member 312 are enclosed within a cover formed of a plastics material of the same kind as is comprised in the embodiment shown in FIGS. 10A and 10B. The cover of the present embodiment is, however, of different shape so as to accommodate the main body 306, the proximal ends of the first and second arms 308, 310 and the rigid protruding member 312 properly. In common with the embodiment shown in FIGS. 10A and 10B, the cover of the present embodiment comprises apertures through which most of the first and second arms 308, 310 protrude.

As can be seen from FIG. 12 the first arm 308 is the same shape as the arms of the embodiment of FIGS. 10A and 10B. The first arm 308 therefore defines a vehicle engaging profile which is defined on two adjacent sides by the first arm and by the main body 306 on one of the other two adjacent sides. The remaining fourth side is open and of a dimension as described above with reference to FIGS. 10A and 10B to receive part of the handlebars 316 of a bicycle. The open end of the vehicle engaging profile defined in part by the first arm 308 is, in use, directed generally away from the rider of the bicycle and therefore in the direction of travel during towing. The second arm 310 comprises a first portion which extends linearly away from main body and a second portion which extends from near the proximal end of the first portion in a direction in line with the main body. The second portion therefore extends towards the rider of the bicycle. The vehicle engaging profile of the second arm 310 is defined by the first and second portions and is oriented away from the main body 306 and towards the rider of the bicycle. This is in contrast to the vehicle engaging profile of the first arm 308 which is oriented towards the main body 306 and away from the rider of the bicycle. The first and second arms 308, 310 are spaced apart from each other along the main body 306 to a sufficient extent that they can fit on opposite sides of the upper triple clamp. As can be seen from FIG. 12 and in contrast to the embodiment of FIGS. 10A and 10B the first attachment arrangement 302 of the present embodiment is attached to the main body 306 on the same side of both of the arms instead of between the arms.

The operation of the embodiment of FIG. 12 will now be described. The user grips the rigid protruding member 312 and orients the towing apparatus 300 such that the second arm 310 fits over one half of the handlebars 316. The user then rotates the towing apparatus 300 so that the first arm 308 fits around and below the other half of the handlebars 316. The user then transfers his or her grip to the handle 314 such that the handle 314 is held against the handlebars 316 as the user grips the handlebars. As can be seen from FIG. 12 the rigid protruding member 312 is shaped such that its distal end extends beyond the distal ends of the first and second arms 308, 310. Configuring the rigid protruding member 312 in this fashion provides for improved retention of engagement of the vehicle engaging profiles of the arms with the handlebars 316 when the handle 314 is gripped against the handlebars 316 by the rider during towing. When towing begins, the first attachment arrangement 302 pulls the part of the vehicle engaging profile defined by the first arm 308 against the handlebars 316 and also causes the main body 306 to pivot about the first arm 308 on account of first attachment arrangement 302 being located on the other side of the first arm 308 to the second arm 310. Pivoting of the main body 306 about the first arm 308 urges the part of the main body 306 on the other side of the first arm to the first attachment arrangement 302 towards the handlebars which in turn pushes the vehicle engaging profile defined by the second arm 310 towards the handlebars 316. This approach is in contrast to the embodiment of FIGS. 10A and 10B which involves the vehicle engaging profiles of both arms being pulled against the handlebars. When towing is complete, the user grasps the rigid protruding member 312. The release of towing force allows the second arm 310 to separate from the handlebars 316. Rotary movement of the towing apparatus 300 by the user disengages the first arm 308 from the handlebars 316 to release the towing apparatus completely from the handlebars 316.

The invention claimed is:

1. Towing apparatus for towing a vehicle with a cable transport arrangement, the towing apparatus comprising:

a first attachment arrangement configured to provide for attachment to a towing part of the cable transport arrangement; and a second attachment arrangement configured for releasable attachment to a vehicle, the second attachment arrangement comprising a main body and first and second arms, the first and second arms being substantially immovably mounted on the main body and spaced apart from each other, each of the first and second arms defining a vehicle engaging profile, the second attachment arrangement being rotatable such that the first and second arms move between: a first position in which the vehicle engaging profiles can be brought into engagement with or disengaged from a part of the vehicle; and a second position in which the vehicle engaging profiles engage with the part of the vehicle so as to provide for towing of the vehicle.

2. The towing apparatus according to claim 1 in which each of the first and second arms extends away from an attachment location on the first attachment arrangement at which the first attachment arrangement attaches to the towing part.

3. The towing apparatus according to claim 1 in which the first and second arms extend from an end of the main body opposite where the main body attaches by way of the first attachment arrangement.

4. The towing apparatus according to claim 3 in which each of the first and second arms extends from a distal part of the main body by between 20 mm and 60 mm.

5. The towing apparatus according to claim 1 in which a distal portion of each of the first and second arms extends generally perpendicularly to an attachment arrangement axis around which the second attachment arrangement rotates between the first and second positions.

6. The towing apparatus according to claim 5 in which a distal portion of an arm extends by between 20 mm and 40 mm in a direction perpendicular to the attachment arrangement axis.

7. The towing apparatus according to claim 1 in which each of the first and second arms defines a recess by way of a nonlinear path between proximal and distal ends of each arm, one of the recesses facing in a first direction substantially orthogonal to a towing direction and the other recess facing in a second direction substantially opposite to the first direction.

8. The towing apparatus according to claim 7 in which the first attachment arrangement is disposed in the towing apparatus such that a towing force is exerted between the first and second arms.

9. The towing apparatus according to claim 1 in which the first arm defines a nonlinear path which defines a first vehicle engaging recess which faces in at least one of a direction of towing and a first direction substantially orthogonal to a towing direction and the second arm comprises a portion which defines at least in part a second vehicle engaging recess which faces away from the main body and away from at least one of a direction of towing and the first direction.

10. The towing apparatus according to claim 9 in which the second arm is on a first side of the first arm and the first attachment arrangement is disposed in the towing apparatus such that a towing force is exerted on a second, opposite side of the first arm.

11. The towing apparatus according to claim 1 in which a surface of the first arm defines at least a part of a first vehicle engaging profile and a surface of the second arm defines at least a part of a second vehicle engaging profile.

12. The towing apparatus according to claim 11 in which each of the first and second vehicle engaging profiles defines at least a part of a recess shaped to fit around a part of a vehicle.

13. The towing apparatus according to claim 11 in which the first and second vehicle engaging profiles are oppositely directed.

14. The towing apparatus according to claim 1 in which the configuration of the first and second arms is such that the second attachment arrangement is rotated by between 70° and 75° when being moved between the first and second positions.

15. The towing apparatus according to claim 1 in which each of the first and second arms comprises a proximal portion and a distal portion and the distal portion defines a surface which forms part of a vehicle engaging profile, with the surface lying on a plane which is at an angle of between 110° and 115° to the proximal portion.

16. Towing apparatus for towing a vehicle with a cable transport arrangement, the towing apparatus comprising:

a first attachment arrangement configured to provide for attachment to a towing part of the cable transport arrangement; and a second attachment arrangement configured for releasable attachment to a vehicle, the second attachment arrangement comprising a main body and first and second arms, the first and second arms being substantially immovably mounted on the main body and spaced apart from each other, each of the first and second arms defining a vehicle engaging profile, the second attachment arrangement being rotatable such that the first and second arms move between: a first position in which the vehicle engaging profiles can be brought into engagement with or disengaged from a part of the vehicle; and a second position in which the vehicle engaging profiles engage with the part of the vehicle so as to provide for towing of the vehicle;

a user grippable handle extending from the second attachment arrangement, the towing apparatus being configured such that the second attachment arrangement is rotatable between the first and second positions by user operation of the handle.

17. The towing apparatus according to claim 16 in which the towing apparatus is configured such that the second attachment arrangement is maintained in the second position during towing by user operation of the handle.

18. The towing apparatus according to claim 16 in which the towing apparatus is configured such that the handle extends generally perpendicularly to an attachment arrangement axis around which the second attachment arrangement rotates between the first and second positions.

19. The towing apparatus according to claim 16 in which the handle comprises a proximal rigid portion and a distal pliable portion.

20. The towing apparatus according to claim 1 configured to tow a bicycle.

21. A towing arrangement comprising a towing part of a cable transport arrangement and towing apparatus according to claim 1, the first attachment arrangement of the towing apparatus being fixed to the towing part.

22. A cable transport arrangement comprising at least one towing part and at least one towing apparatus according to claim 1, the first attachment arrangement of a towing apparatus being fixed to a towing part.

* * * * *